US005992676A

United States Patent [19]

Tsai

[11] Patent Number: 5,992,676

[45] Date of Patent: Nov. 30, 1999

[54] EXPANDABLE SUPPORT STRUCTURE OF KITCHEN BASKET

[76] Inventor: Wun-Hsien Tsai, P.O. Box 487, Changhua, Taiwan

[21] Appl. No.: 09/113,900

[22] Filed: Jul. 13, 1998

[30] Foreign Application Priority Data

Mar. 12, 1998 [TW] Taiwan ..... 87203572

[51] Int. Cl.[6] ..... B65D 5/00

[52] U.S. Cl. ..... 220/485; 220/629

[58] Field of Search ..... 220/485, 494, 220/495, 629, 9.2, 9.3, 9.4

[56] References Cited

U.S. PATENT DOCUMENTS 1,493,948 5/1924 Apple ..... 220/629 X
1,801,055 4/1931 Roos ..... 220/629
1,810,855 6/1931 Rockmore ..... 220/629 X
4,969,569 11/1990 Anders ..... 220/629

*Primary Examiner*—Steven Pollard

[57] ABSTRACT

A kitchen basket is composed of a basket, two support frames and two expandable support rods of a U-shaped construction. The basket is held by the two support frames, which are provided with the retaining portions for engaging the expandable support rods in such a manner that the expandable support rods can be extracted and retracted to facilitate the suspending of the basket in a kitchen sink. The basket is further supported by two metal strips, which are fastened to the underside of the basket. The metal strips are provided with legs to locate the kitchen basket on a kitchen table. The expandable support rods are provided respectively with two skidproof pads for locating the kitchen basket at such time when the kitchen basket is suspended in a kitchen sink.

4 Claims, 5 Drawing Sheets

EXPANDABLE SUPPORT STRUCTURE OF KITCHEN BASKET

FIELD OF THE INVENTION

The present invention relates generally to a kitchen basket, and more particularly to an expandable support structure of the kitchen basket.

BACKGROUND OF THE INVENTION

As shown in FIG. 1, a kitchen basket 1 of the prior art is composed of a basket 11, two U-shaped support rods 13, and two retaining tubes 12. The basket 11 is held by the two support rods 13, which are extractably and retractably retained by the two retaining tubes 12 opposite in location to each other. The support rods 13 are provided with two flat free ends 131 to avert the disengagement of the support robs 13 with the retaining tubes 12 when the support rods 13 are extracted to expand the support structure of the kitchen basket 1.

Such a prior art support structure of the kitchen basket as described above is defective in design in that it is not cost-effective, and that it is not esthetically sound, and further that it is incapable of holding the basket 11 in place when the basket II contains fruits, vegetables, dishes, etc.

SUMMARY OF THE INVENTION

The primary objective of the present invention is therefore to provide a kitchen basket with a support structure consisting of two support frames and two expandable support rods which are concealed by the support frames so as to enhance the esthetic effect of the kitchen basket.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
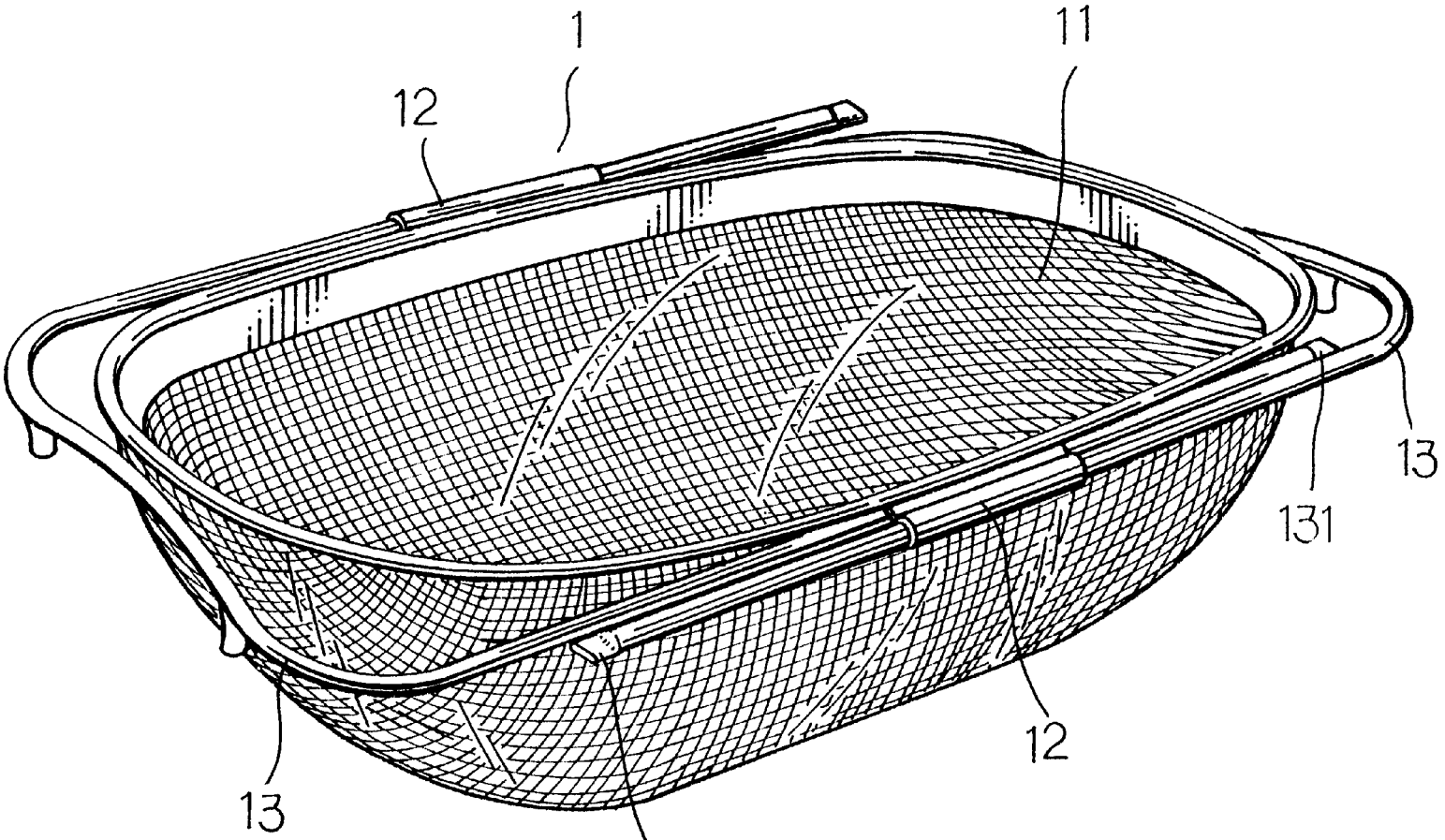
FIG. 1 shows a perspective view of a kitchen basket of the prior art.
Figure 2:
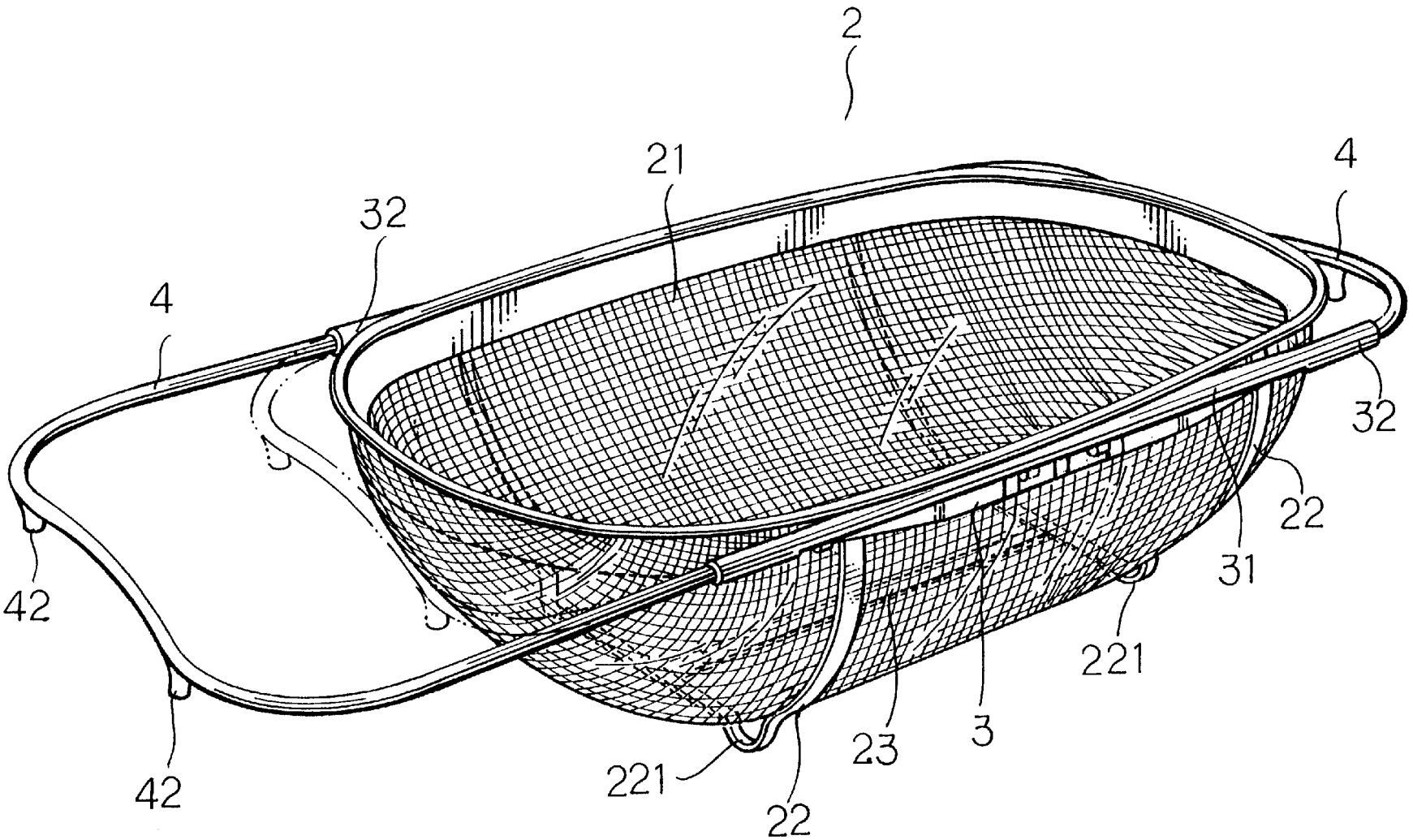
FIG. 2 shows a perspective view of a kitchen basket of the present invention.
Figure 3:
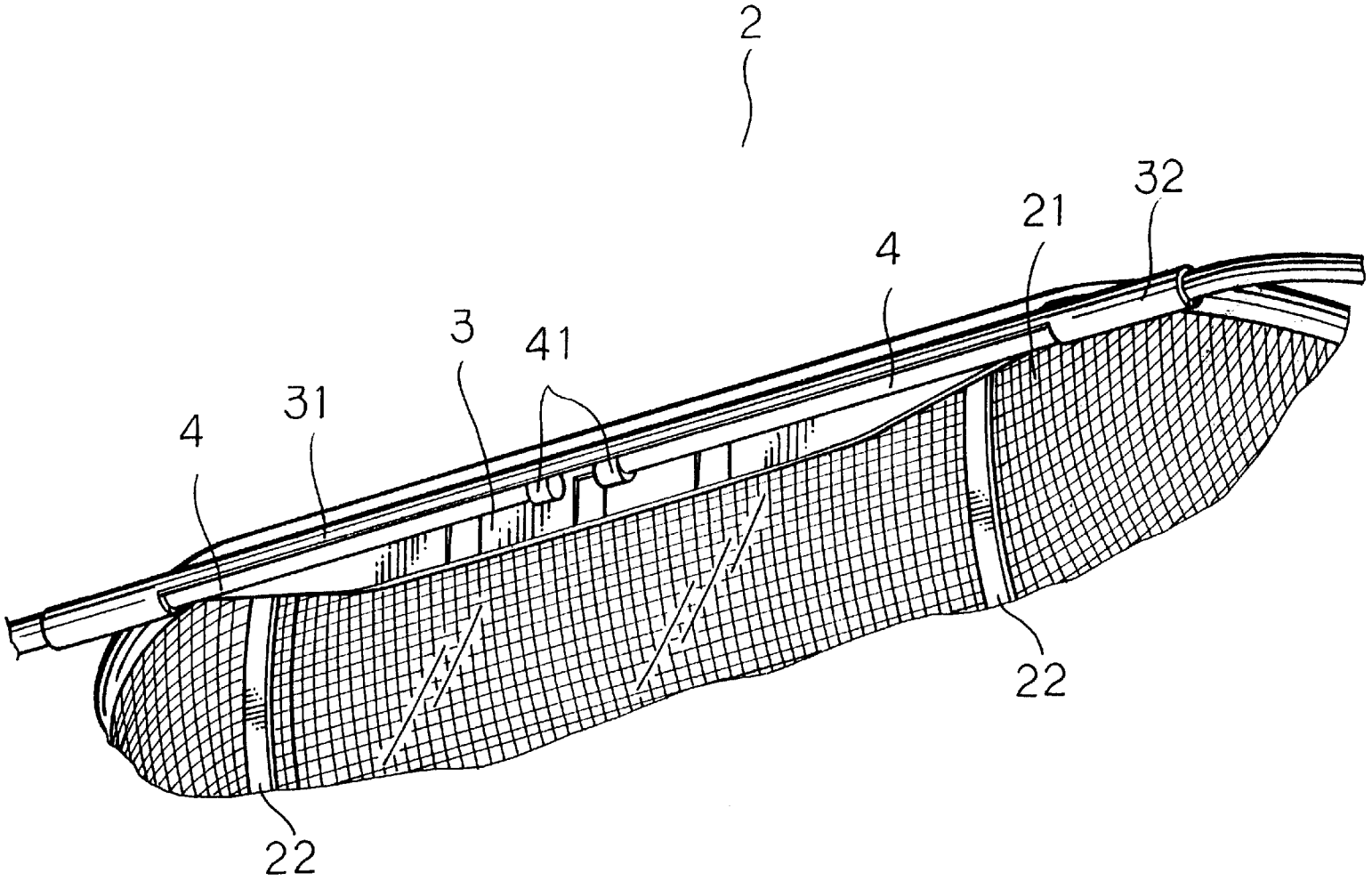
FIG. 3 shows a bottom view of the kitchen basket of the present invention.
Figure 4:
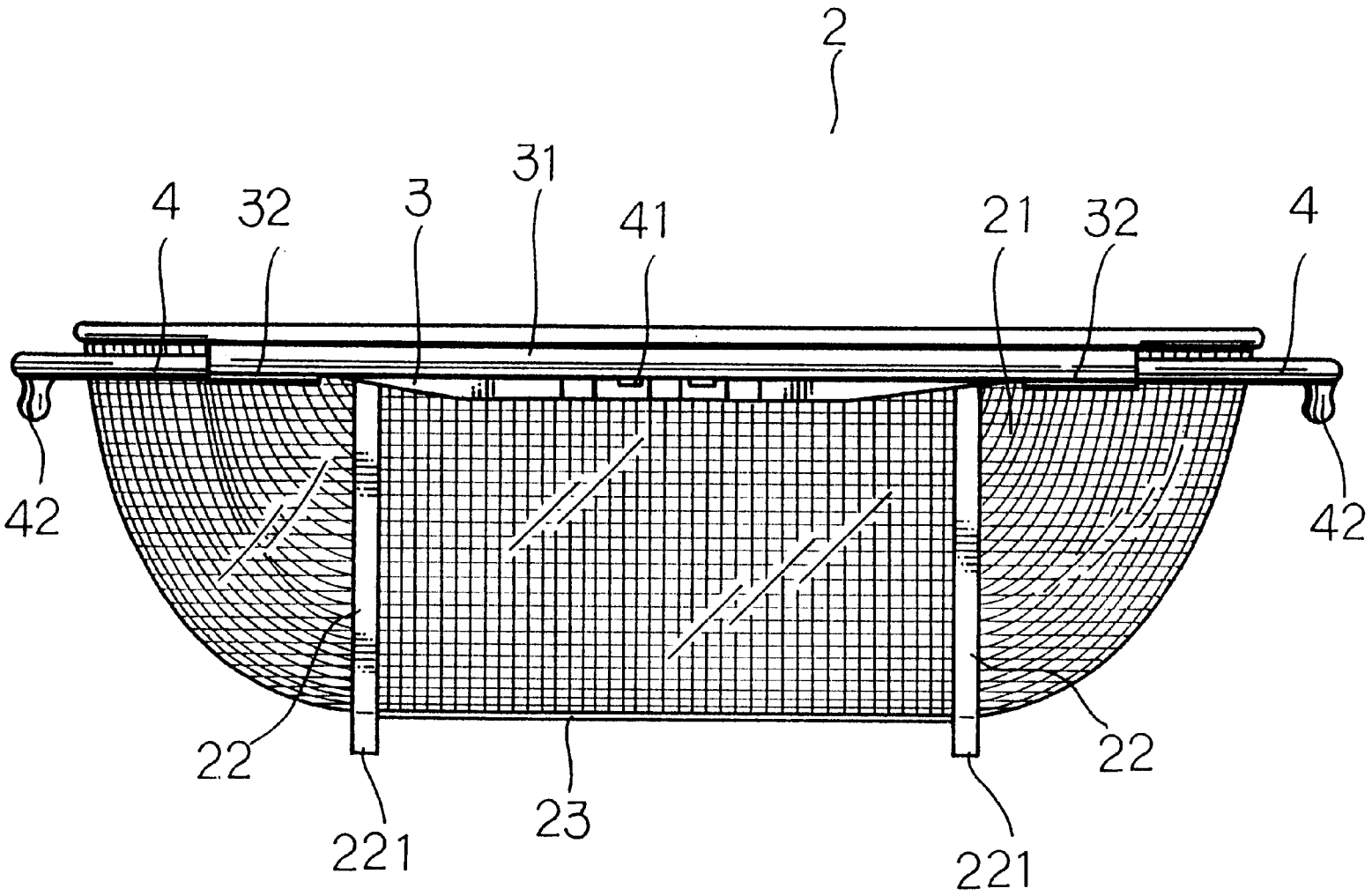
FIG. 4 shows a side view of the kitchen basket of the present invention.
Figure 5:
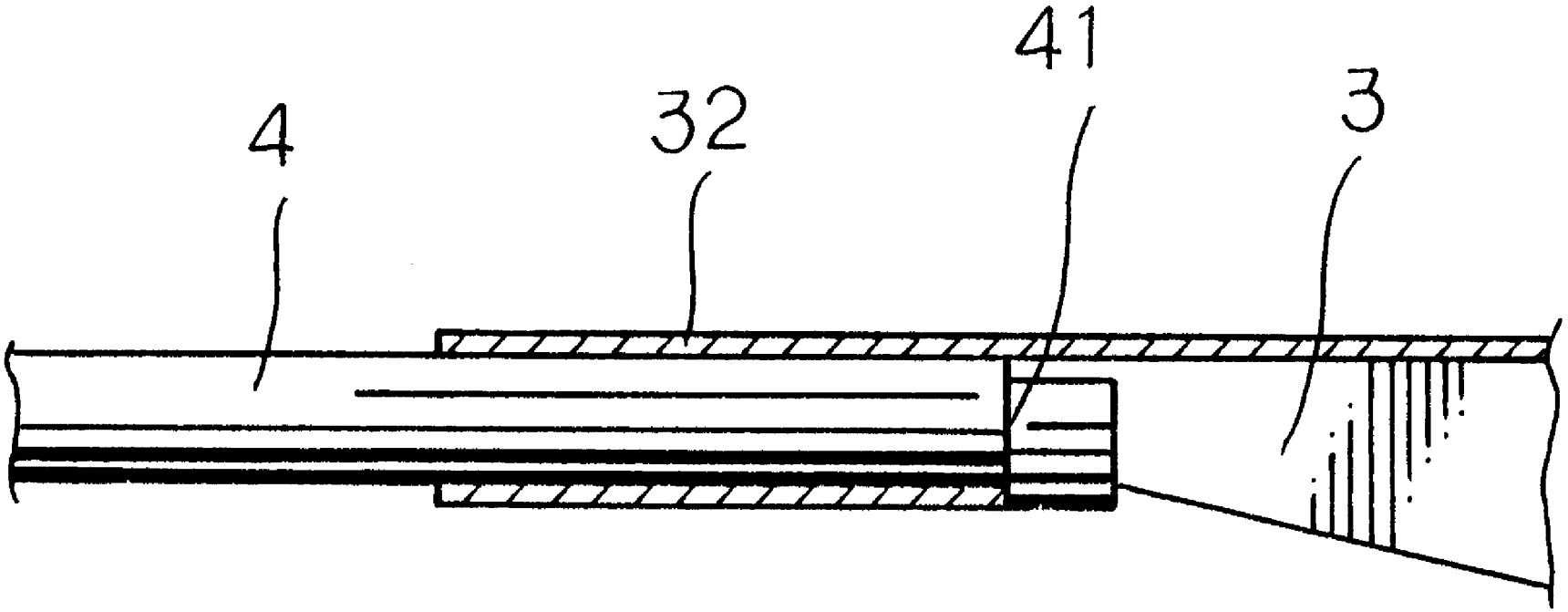
FIG. 5 shows a partial sectional view of the kitchen basket of the present invention.

As shown in FIGS. 2–5, a kitchen basket 2 embodied in the present invention is composed of two support frames 3, two expandable support rods 4, and a basket 21.

The support frames 3 are respectively composed of a frame rod 31 which is made of a metal material by punching and pressing and is provided respectively at both ends thereof with a retaining portion 32.

The expandable support rods 4 are of a U-shaped construction and are made of a metal material. Each of the two expandable support rods 4 has two free ends, which are extractably and retractably received in the retaining portions 32 of the frame rod 31. The free ends of the support rods 4 are provided respectively with a stopping portion 41. The crown portion of the U-shaped support rods 4 is provided with two skidproof pads 42 fastened thereto.

The basket 21 is supported by two metal strips 22 which are attached around the underside of the basket 21 such that both ends of the two metal strips 22 are fastened with the support frames 3. Located between the two metal strips 22 is a support plate 23 which is fastened at both ends thereof with the metal strips 22. Each of the two metal strips 22 is provided with two legs 221. The metal strips 22 are attached to the underside of the basket 21 by welding.

The expandable support rods 4 can be pulled out to place on the edges of a kitchen sink such that the basket 21 is suspended in the kitchen sink to facilitate the washing and the air drying of fruits, vegetables, and dishes which are kept in the basket 21. The basket 21 can be located stably on a kitchen table, thanks to the legs 221 of the metal strips 22.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A kitchen basket comprising two support frames, two expandable support rods, and a basket held by said two support frames;

wherein said two support frames are composed of a metal frame rod which is provided respectively at both ends thereof with a retaining portion;

wherein said two expandable support rods are of a U-shaped construction and provided with two free ends which are extractably and retractably received in said retaining portions of said frame rods and are provided with a stopping portion; and wherein said basket is provided in and underside thereof with two metal strips fastened therewith such that said metal strips are fastened at both ends thereof with said support frames.

2. The kitchen basket as defined in claim 1, wherein said two expandable support rods are provided respectively at a crown portion thereof with a plurality of skidproof pads.

3. The kitchen basket as defined in claim 1, wherein said basket is provided in the underside thereof with a support plate which is fastened between said two metal strips.

4. The kitchen basket as defined in claim 1, wherein said metal strips are provided respectively with two legs.

* * * * *